United States Patent [19]

LeBaron

[11] 4,392,266

[45] Jul. 12, 1983

[54] MOLDED SHANKS

[75] Inventor: Steven M. LeBaron, Swampscott, Mass.

[73] Assignee: Bush Universal, Inc., Woburn, Mass.

[21] Appl. No.: 339,784

[22] Filed: Jan. 15, 1982

[51] Int. Cl.[3] ..... A43D 31/00; A43D 21/00

[52] U.S. Cl. ..... 12/146 S; 12/40.5; 12/18.3; 36/76 R

[58] Field of Search ..... 12/1 G, 18.3, 33.6, 12/40.5, 146 S; 36/76 R

[56] References Cited

U.S. PATENT DOCUMENTS

| | | | |
|---|---|---|---|
| 1,714,670 | 5/1929 | Hiss | 36/76 R |
| 1,722,029 | 7/1929 | Bancroft | 12/146 S |
| 2,414,707 | 1/1947 | Barnett | 36/11.5 |
| 2,872,746 | 2/1959 | Maccarone | 36/76 R |
| 3,142,910 | 8/1964 | Levine | 36/76 R |
| 4,161,048 | 7/1979 | Stanton | 12/146 S |
| 4,236,268 | 12/1980 | Bradley et al. | 12/146 S |

*Primary Examiner*—Werner H. Schroeder
*Assistant Examiner*—Steven N. Meyers
*Attorney, Agent, or Firm*—Wolf, Greenfield & Sacks

[57] ABSTRACT

A spring-type shank for a shoe sole is formed on the bottom of a shoe assembly during manufacture of the shoe. The heel end of the shank is formed so that it is raised slightly from the heel seat region of the insole to provide a "spring shank". The shank is formed directly on the bottom of the shoe insole from a strip of initially flexible, uncured thermosetting material which may be fiber reinforced. The spring portion at the heel end of the shank is formed by placing a wedge between the shoe insole and the heel end of the shank strip during the curing process thereby to cause the heel end of the shank strip to cure in a raised, inclined attitude, spaced from the bottom of the insole, while the more forward, remaining portions of the shank strip cure in secure attachment to the insole bottom.

11 Claims, 11 Drawing Figures

6
6
120
122
118
138
136
116
142
124
104
134
140
56
84
94
108
132
16
142
82
80
38
126
68
138
60
106
36
62
102
100
66
30
66
64
128
130
72
70
70
74
76
78
98

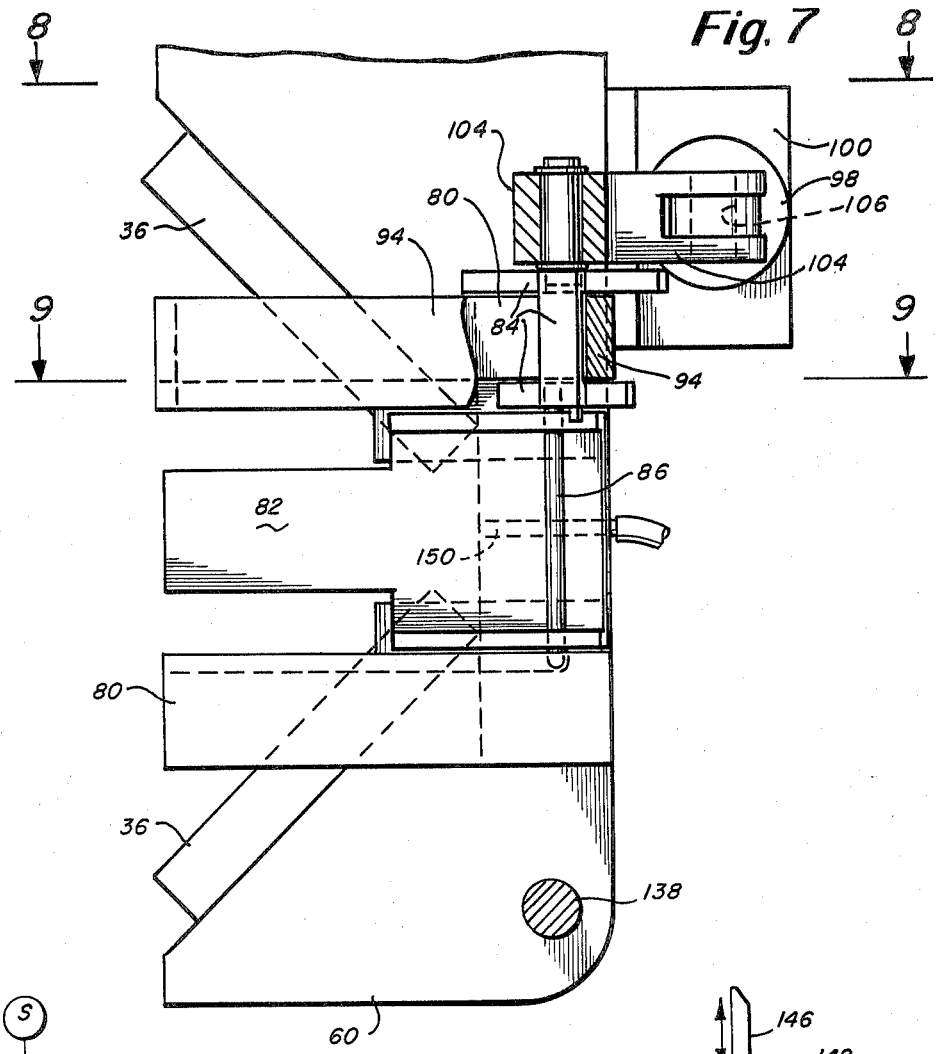
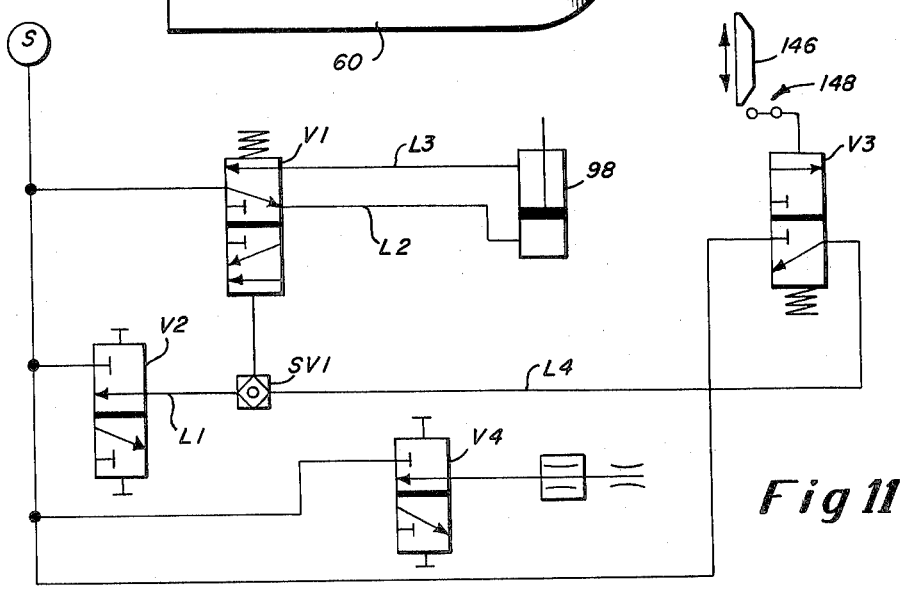
Fig 11

MOLDED SHANKS

BACKGROUND OF THE INVENTION

This invention relates to a method and apparatus for forming a shoe shank on the bottom of a shoe insole to stiffen the shank region of the shoe. More particularly, the present invention is directed to further improvements in the methods and apparatus for applying, locating, retaining and curing a flexible strip of activatable thermosetting resinous material directly in situ on the shoe bottom so that the strip will conform to the contour of the shoe bottom and adhere thereto in stiffened, hardened form. Such strip materials are described in U.S. Pat. No. 4,081,917, issued Apr. 4, 1978; U.S. Pat. No. 4,122,573 issued Oct. 31, 1978 and others assigned to the assignee of this invention. The present invention relates to further improvements to the method and apparatus described in U.S. Pat. No. 4,161,048, issued July 17, 1979 to the assignee in this application, for applying the material to the shoe bottom.

The techniques and apparatus described in the foregoing patents have been receiving increased acceptance in the shoemaking industry in recent years. As described in further detail the above-mentioned patents, the use of the flexible, activatable strips to form a shank stiffener directly in situ on the shoe bottom solved numerous problems which had been presented in the prior art of shoe manufacture. Generally, as described in the above-mentioned patents, shank stiffeners typically have been inserted in shoes in the form of a stiff wood or steel preformed member. Because of the wide variety of styles and sizes of shoes, the typical prior practice required the manufacturer to maintain an inventory of a wide variety of different sizes and shapes of shanks. Many difficulties had been presented in the storage, proper selection and installation of such shanks. By utilizing the inventions described in the above-mentioned patents, a single flexible shank strip may be formed directly in place on the bottom of a shoe of any shape to conform precisely to the shape of the insolve bottom and then may be hardened in place in that shape by an external stimulus, such as radiant energy.

While in most instances, it is desirable to have a full longitudinal attachment of the shank strip to the insole bottom (sometimes referred to as a "dead fit") there may be some instances in which it is preferred that the heel portion of the shank strip be raised and spaced slightly from the heel region of the insole. This type of shank construction is sometimes referred to as a "spring fit" or a "spring shank" has been used in the prior art with metal shanks, particularly in the manufacture of some types of women's shoes. The purpose for using a spring shank during the manufacture of a shoe is to provide an automatic means to correct errors which may be made during the shoe manufacturing process. For example, if the shoe upper is not formed or cut precisely as intended, or if the upper is not pulled over properly, or if the heel height of the shoe is not just right, a spring shank may be incorporated to minimize the effects of these, and other, manufacturing errors.

In general, the object of the spring shank is to create a temporary spring force within the shoe assembly during the manufacture of the shoe, which spring force is released automatically when the shoe is finished and is removed from the last on which the shoe was formed.

During the manufacturing process, the shoe is retained firmly on the last and the tension or prestressing imposed by the spring shank has no effect on the shape of the shoe. However, when the shoe is finished and the last is removed, the spring then is free to return to its unstressed, natural configuration and will, of course, draw the shoe to the configuration of the shank. The natural relaxed configuration of the spring shank is in a more arched direction than the shoe was when it was on the last. Thus, when the last is removed, the shoe sole will be flexed in a more arched direction which will tend to tighten the top line of the shoe, smoothen out wrinkles in the upper and generally correct many of the manufacturing errors which may have occurred in the manufacturing process.

In general, the shoe manufacturing process, when using a spring shank, includes the location of a shank element on the bottom of the insole but in a manner in which the heel end of the shank will be raised slightly from the heel end of the insole. The shoe otherwise is manufactured in accordance with standard techniques, with the heel being attached toward the end of the manufacturing procedure. As the heel is applied, it is pressed against the raised heel end of the shank to decrease the extent of arch in the shank while simultaneously stressing the shank from is normal, more arched configuration to a stressed, less arched configuration. The manufacture of the shoe is completed with the shank in this prestressed configuration. Once the shoe has been finished and it is removed from the last, the shoe is free to flex under the influence of the prestressed shank. Thus, when the prestressed shank returns to its relaxed, more arched configuration, it will tend to cause the shoe to arch somewhat, thereby tightening the top line, the upper, and assuring a good tread.

SUMMARY OF THE INVENTION

The present invention relates to the use of a wedge-shaped element which is interposed between the shank strip and heel seat of the insole. The wedge serves to hold and support the heel end of the shank strip in an inclined attitude, spaced from the bottom of the insole the shank is being activated in situ on the shoe bottom. The wedge is constructed so as to be withdrawn after the shank strip has been cured to enable removal of the shoe from the machine without stripping the shank from the shoe bottom. Means are provided to assure that the wedge does not become gummed up with cured resin. The wedge is constructed so as to provide a fine and critical control as to the height and angle of the spring portion of the shank. Means also are provided for disabling the shank from operating so as to enable the machine to be utilized in the manufacture of shoes having conventional dead fit shanks.

It is among the general objects of the invention to provide improved method of apparatus for making shoes having spring shanks, which the shanks are formed from a strip of initially flexible thermosetting plastic material.

A further object of the invention is to provide a method of apparatus of the type described which assures uniformity and regularity in all spring shank shoes which are manufactured utilizing the technique of the invention.

Another object of the invention is to provide a machine for applying and activating externally activatable shank strips in which means are provided to form either dead fit shanks or spring shanks as may be selected by the operator.

DESCRIPTION OF THE DRAWINGS

The foregoing and other objects and advantages of the invention will be appreciated more fully from the following further description thereof, with reference to the accompanying drawings wherein:

FIG. 7 is an enlarged plan illustration of the wedge mechanism as seen along the line 7—7 of FIG. 6;

DESCRIPTION OF THE PREFERRED EMBODIMENT

Figure 1:
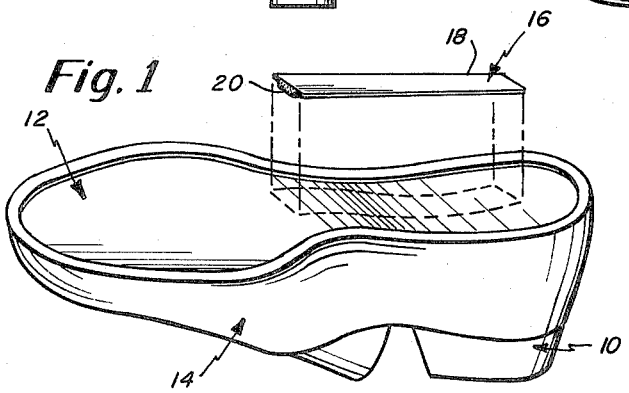
FIG. 1 shows a shoe assembly, bottom up, illustrating the manner in which the shank strip may be located on the shoe bottom.

As shown in FIG. 1, the shoe assembly includes a last 10 having an insole 12 on its bottom and an upper 14 mounted on the last 10. Marginal portions of the upper 14 already will have been lasted to corresponding marginal portions of the insole 12. The shank strip 16 includes an elongate sleeve 18 of flexible material which contains a matrix of thermosetting resin 20 and a plurality of reinforcing fibrous strands embedded in the resin. The resin 20 is activatable by a selected external stimulus, such as heat. The sleeve 18 is formed from a material which can transmit the external activating stimulus to the resinous matrix. For example, the activating stimulus may be infrared energy in which case the sleeve preferably is formed from a substantially transparent plastic material which will transmit the infrared radiation to the resinous matrix. The shank strip 16 typically will be cut from a long supply thereof and a severed strip will be applied to the bottom of a shoe assembly in a machine of the type with which the present invention is concerned, and preferably embodies features and mode of operation described in U.S. Pat. No. 4,161,048 issued to the assignee in this application. As described generally in said patent, the machine incorporates devices and techniques by which the lasted shoe assembly is held securely in place and a shank strip which is located on the bottom of the shoe assembly then is urged against the bottom of the shoe assembly so that it conforms to the contour of the shoe assembly. While so held, the strip is activated to cause the shank strip to be cured and secured in place on the shoe bottom.

Figure 2:
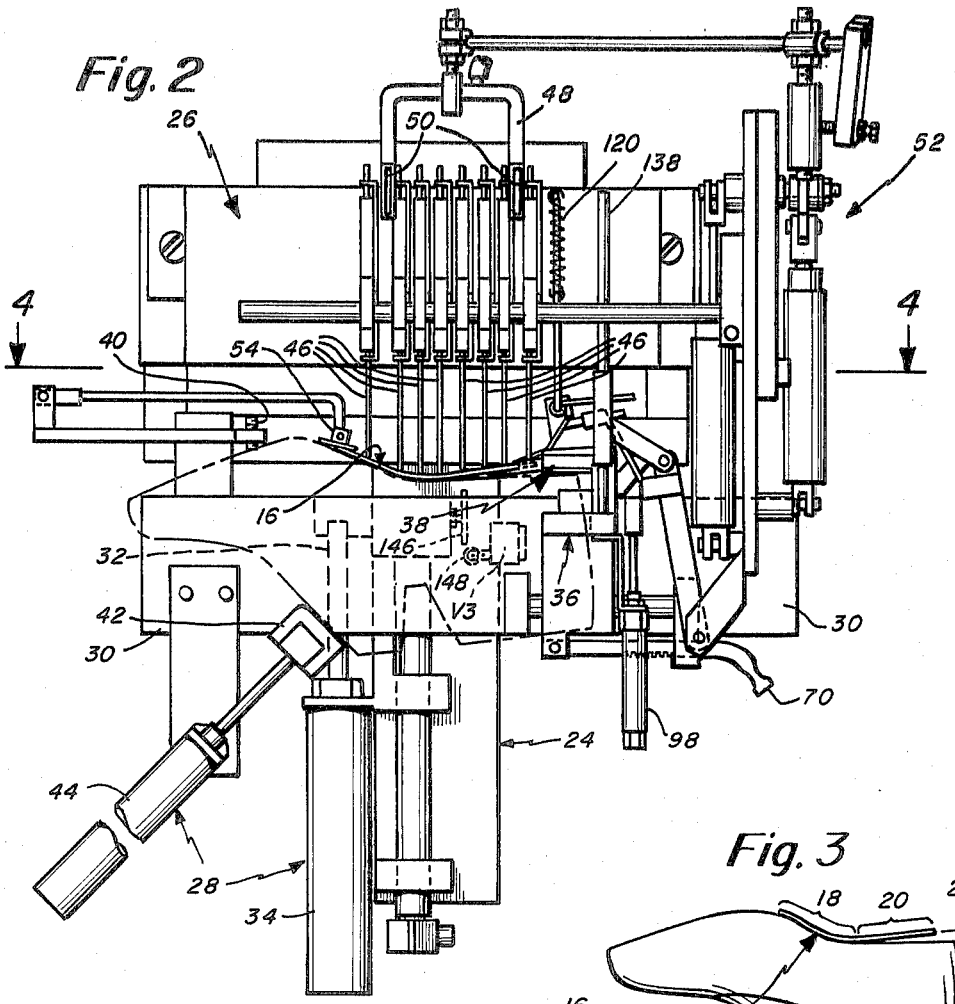
FIG. 2 is a side elevation of a shoe assembly, illustrating the intended configuration for the spring shank strip when it has been cured and after it is removed from the machine.

As described in U.S. Pat. No. 4,161,048, the shank strip is applied to the bottom of the shoe assembly and conforms to and adheres to the shoe assembly bottom, substantially and fully along the length of the shank strip. In accordance with the present invention, the shank strip is shaped as it is cured so that the heel end of the shank strip does not lie flat against the insole but, instead is used in a configuration extending away from the insole, at an angle to the bottom of the shoe. This is suggested in FIG. 2 which illustrates, diagrammatically, the shank strip 16 in which its forward region 18 is cured and securely adhesively attached to the insole bottom, while the heelward portion 20 is raised and extends away from the insole at an angle 22. The present invention relates to modifications in the machine described in U.S. Pat. No. 4,161,048 by which the flexible shank strip is held in a position so that it can be cured to result in the configuration shown in FIG. 2.

The mechanism utilized in the present invention will be described with reference to the apparatus described in U.S. Pat. No. 4,161,048, the full and complete details of the structure and operation of the machine being described in said patent. For purposes of understanding the environment in which the present invention is incorporated, a description of that machine will be abbreviated and will be only to the extent necessary to understand the present invention. For a more detailed explanation of the operation of the machine, reference is made to U.S. Pat. No. 4,161,048.

Figure 3:
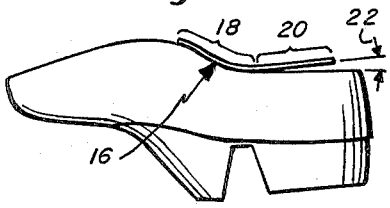
FIG. 3 is a side elevation of the machine of the type shown in U.S. Pat. No. 4,161,048 modified to include the present invention.

The machine, illustrated in elevation in FIG. 3, includes a frame 24 to which the various elements of the machine are mounted. For ease of description, directions extending to the left as seen in FIG. 3 will be referred to as forward or toeward and directions extending to the right will be considered as heelward or rearward. Directions toward and away from the operator's normal postion (in which the machine would appear as suggested in FIG. 3) will be referred to as lateral, transverse or widthwise.

A radiant energy source, such as an infrared heater 26, is mounted to a overhead portion of the frame. The heater 26 includes a heating element and is arranged to reflect and direct infrared radiation downwardly toward a shoe assembly (shown in phantom in FIG. 3) which is supported bottom up in the machine. The radiant heater 26 is arranged to direct the radiant energy downwardly toward the shoe bottom when the shoe is supported in the machine.

The shoe assembly is intended to be held firmly in the machine by a shoe jack assembly, indicated generally by the reference character 28. The shoe jack assembly is guided for vertical movement toward and away from the heater 26, between a lowered, loading position and a raised, operating position (shown in FIG. 3). The shoe jack assembly 30 includes a forwardly-rearwardly extending main support bar 30 which is connected to and driven vertically by the piston rod 32 of a cylinder 34 (preferably pneumatic) which is secured to a portion of the frame 24. The main support bar 30 carries the various shoe clamping elements including a V-shaped heel locator 36, heel abuttment 38, ball abuttment 40 and cone clamp 42. The cone clamp 42 is connected to the piston rod of a cylinder 44 and is operated to secure the shoe assembly with its heel pressed firmly into the heel locator 36, with the heel seat of the shoe firmly against the heel abuttment 38 and the ball portion of the shoe firmly against the ball abuttment 40. When in the clamped position (as shown in phantom in FIG. 3), operation of the air cylinder 34 raises or lowers the entire shoe jack assembly thereby raising and lowering the shoe assembly as a unit. Means are provided to adjust the heel locator 36, heel abuttment 38 and ball abuttment 40 to assure that operation of the cone clamp 42 will secure the particular shoe assembly in the proper position with respect to the other elements of the machine.

The machine also includes an arrangement by which the shank strip is engaged and pressed against the bottom of the shoe assembly when the shoe assembly is raised by the jack. As described in further detail in U.S. Pat. No. 4,161,048, the machine includes a pair of generally parallelling rows or groups of downwardly extending spaced fingers 46, the ends of which engage opposite marginal edges of the shank strip when the shoe and shank strip are raised toward the heater 26. The lower ends of the fingers, which engage the margins of the shank strip, are disposed well below the heater 26 but well above the location of the shoe assembly when the shoe assembly is initially clamped in the shoe jack assembly 28? The fingers 46 may be spring loaded to assure that they will bear downwardly toward and against the insole bottom to hold the shank strip.

The machine also includes means to suspend a shank strip below the ends of the fingers 46 but above the bottom of the shoe assembly which is supported in the shoe jack 28. The shank strip 16 is suspended by a transfer head 48 having vacuum pads 50 which hold the shank strip pad while a transfer mechanism 52 is operated to swing the transfer head 48 and strip downwardly between the fingers 46 and the lowered shoe assembly. With the shank strip so suspended, the shoe jack assembly 28 is operated to raise the shoe, so that the insole engages the shank strip 16 which continue to move upwardly in unison, under the influence of the air cylinder 34. The shank transfer head 48 is movably mounted so that it, too, will move upwardly with the shoe assembly and shank strip. The entire assembly continues to move upwardly until the fingers engage the margins of the shank strip. The fingers also are mounted for heightwise movement in response to continued upward advancement of the shoe jack 26 and shoe assembly.

When the shoe has been raised to its most upward position, the shank strip transfer mechanism releases its vacuum grip on the shank strip and is moved upwardly and laterally from the shoe assembly to a remote position (indicated in FIG. 3). As described more fully in U.S. Pat. No. 4,161,048, the machine then operates to activate the heater 26 to cure the shank strip in place on the shoe bottom. The heater 26 is operated for predetermined interval, determined by a timing mechanism and, at the end of exposure, the various drive cylinders of the machine are returned to their starting positions which causes the machine to release the shoe assembly for removal from the machine.

Presser pads, including a toe pad 54 and heel pad 56 also are provided to assure that the heel and toe ends of the shank strip are engaged and press firmly downwardly during activation. As described in U.S. Pat. No. 4,161,048, the fingers 46, and heel presser pads serve to press the entire shank strip, including the heel end, directly toward the bottom of the shoe insole.

In accordance with the present invention, it is among the prime objects to provide an arrangement by which the more rearward portion of the shank strip is not attached to the insole bottom but, instead, is cured while supported in an upwardly extending, angled configuration, thereby to provide a shank. To that end, the machine has been modified in accordance with the present invention to provide a wedge-shaped shank strip support which can be positioned to overlie the heel seat of the shoe assembly to provide a wedged spacer between the insole and the heel end of the shank strip. When the shank strip 16 is urged toward the insole bottom, its more forward portions will bear directly against the insole bottom while the heelward end of the shank strip will rest on the wedge and will cure in a raised, spring-shank configuration.

The heel unit, which includes the V-heel locator 36, the heel seat abuttment 38, the heel wedge mechanism and heel presser pad device is supported by the main support bar 30 for heightwise movement in unison with the shoe assembly under the influence of cylinder 34. In addition, the heel-engaging instrumentalities of the heel unit also are longitudinally adjustable with respect to the main support bar 30 to enable the device to accommodate a complete range of shoe sizes. To that end, the various heel-engaging instrumentalities are carried by a carrier plate 60 which, in turn, is slideably mounted with respect to the main support bar 30. The carrier plate 60 is secured to a downwardly extending slide 62 (FIGS. 5 and 6) which is slideably mounted on a rail 64. The rail 64 extends forwardly-rearwardly in the machine, parallel to the main support bar 30 and is secured to the main support bar 30 by a pair of support brackets 66. A stabilizing guide 68 is secured to the slide 62 and overhangs the upper edge of the support bar 30 (FIG. 6) to guide the slide 62 and carrier plate to motion which parallels the rail 64 and prevents rotary movement of the system about the rail 64.

In order to adjustably position the heel unit instrumentalities for a particular size of shoe, the carrier plate 60, slide 62 and the various heel-engaging instrumentalities carried on the carrier plate are adjustably positioned to the desired location along the rail 64. In order to latch the carrier plate 60 in the selected position, as well as to facilitate movement of the carrier plate 60, a positioning handle 70 is pivoted, at 72, to the lower end of the slide 62. The rearwardly extending portion of the positioning handle 70 is provided with a plurality of longitudinally spaced grooves 74 which are engageable with an edge 76 of a transversely extending plate which may be secured to the rear support bracket 66. In order to adjust the longitudinal position of the heel unit, the handle 70 is raised slightly to disengage the groove 74 from the bar 78. The handle 70 then can be urged forwardly or rearwardly, thereby urging the slide 62 to any desired position, and then is released to enable one of the grooves 74 to relatch over the edge 76 of the bar 78 to hold the heel unit in the selected position.

The heel unit includes the V-shaped heel locators 36 (see FIGS. 6, 7) which form a V-shaped pocket against which the heel of the shoe is placed to define the heelwardmost position of the shoe in the machine and serve as a primary reference point in locating the shoe. The heightwise position of the heel of the shoe assembly in the heel is determined by the heel seat abuttment 38 which, in the illustrative embodiment, includes a pair of fingers 80 which are spaced above the carrier plate 60 and extend forwardly over and between the V-shaped locators 36 (see FIG. 7). The fingers 80 define a reference surface against which the heel seat of the shoe assembly can be located to fix the heightwise position of the heel seat of the shoe in the heel unit. Thus, when the shoe is positioned in the machine, its heel end is inserted into the heel unit, the shoe assembly being urged rearwardly into engagement between the V-shaped locators 36 and simultaneously upwardly into engagement with the underside of the fingers 80. Simultaneously, the operator positions the toe end of the shoe assembly upwardly into engagement with the toe locators 40. When so positioned, the cone clamp 42 is actuated to urge the shoe assembly firmly against the foregoing abuttments and the entire assembly is raised under the influence of cylinder 34 to engage the shank strip, and then the retaining fingers and then to a position where the heater 26 may activate the strip 16.

In accordance with the present invention, the heel unit includes a wedge 82 which is located between the transversely spaced fingers 80 and is mounted on the heel abuttment 38 for movement between a heelward, retracted position and a forward, extended position in which the wedge 82 will lie over that part of the insole which would normally receive the heel end of the shank strip 16. When the wedge 82 is in its extended, forward position, the heelward end of the shank strip will rest on the wedge 82 and may be pressed downwardly against the wedge by the heel holddown, as will be described (see FIG. 5). When the shank is placed and cured on the wedge 82, it will result in a spring shank as suggested in FIG. 2. When the machine is operated with the wedge in the retracted position, the shank strip is formed fully along the shoe bottom, with no "spring" at the heel end.

Figure 6:
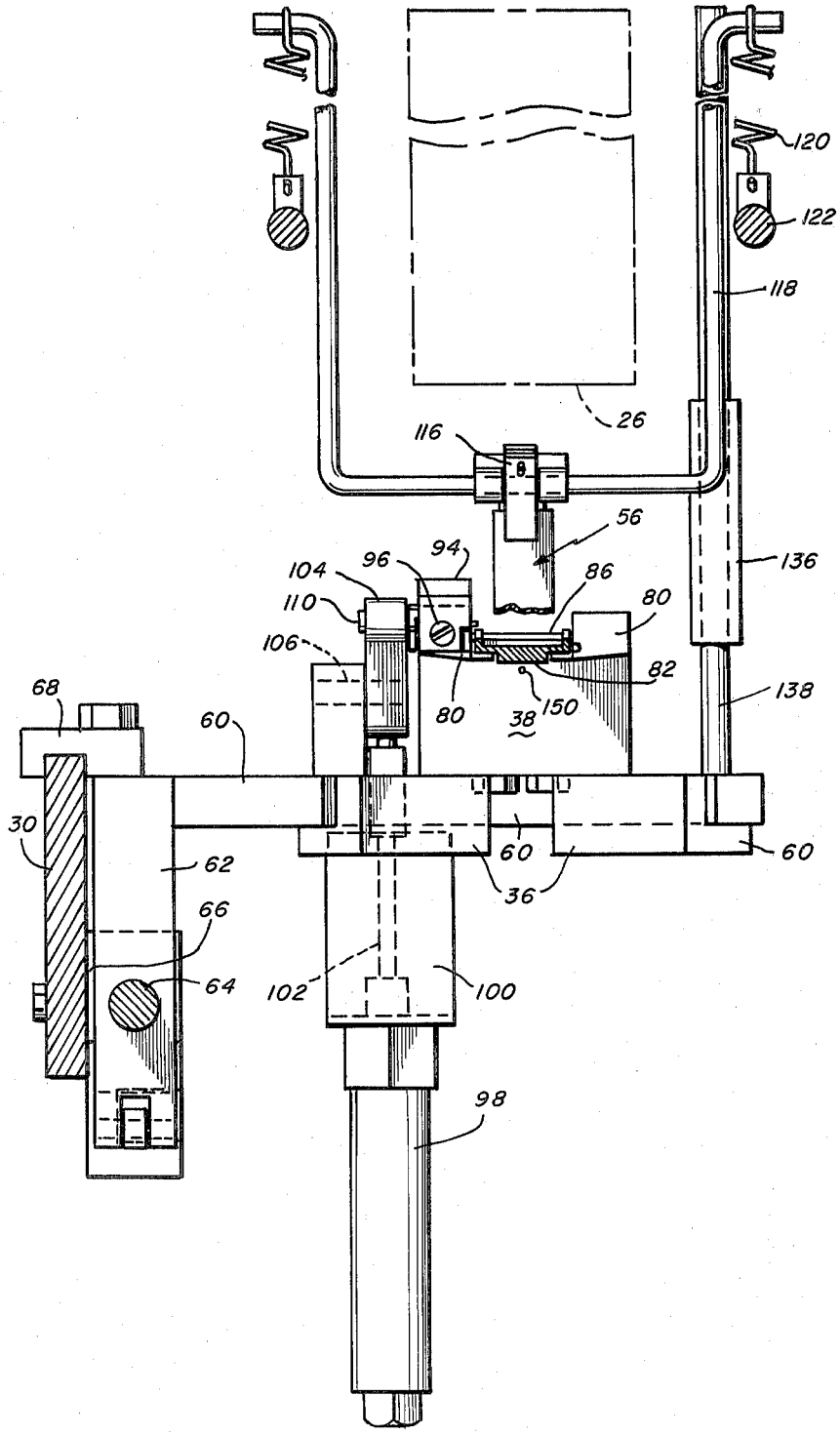
FIG. 6 is an elevation of the wedge mechanism, as soon looking in a heelward direction, along the line 6—6 of FIG. 5.

The wedge 82 may be mounted for forward-rearward movement between the abuttments 80, and in the illustrative embodiment of the invention, the wedge 82 is pivotally mounted to a slide 84 by a pin 86. The slide 84 is U-shaped in cross section (see FIG. 10) and slides over the upper surface 88 of one of the heel abutment fingers 80. One end of the pin 86 is rotatably mounted to the slide 84 and the other end of the pin 86 is contained within a generally forwardly-rearwardly extending slot 90 formed in the other of the fingers 80. When the slide 84 is urged to its forwardmost position, to extend the wedge 82, the extent to which the wedge can freely pivot downwardly about the axis of the pin 86 is limited by a small stop 92 which extends from the slide and engages a portion of the wedge 82. A cap 94 preferably is provided over the upper surface 88 of the finger 80 which carries the slide 84 to retain the slide in place. The cap 94 may be secured to the ends of the finger 80 as by screws 96 (FIG. 6).

Figure 5:
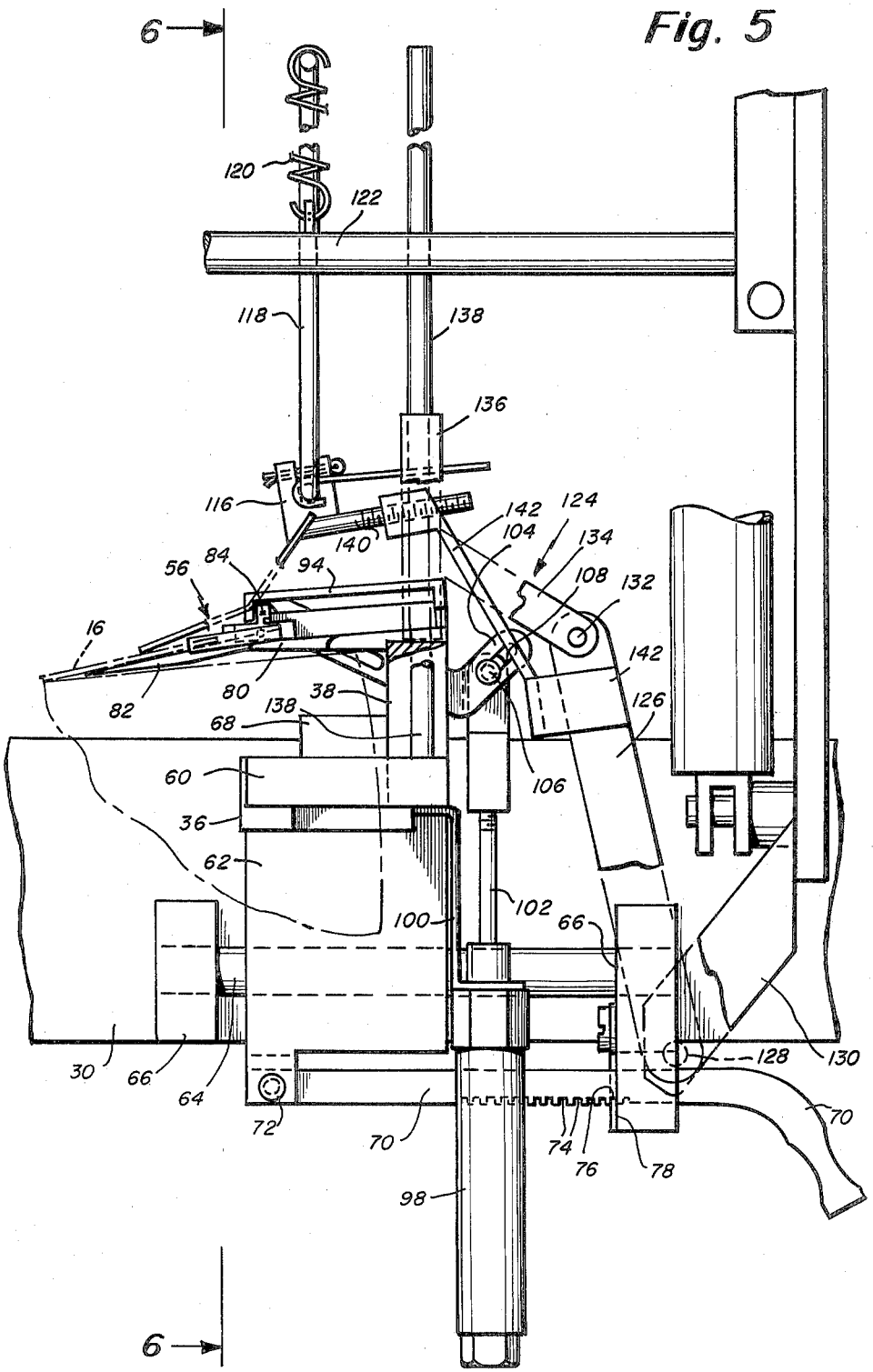
FIG. 5 is an enlarged side elevation of the wedge mechanism portion of the machine as seen along the line 5—5 of FIG. 4.
Figure 8:
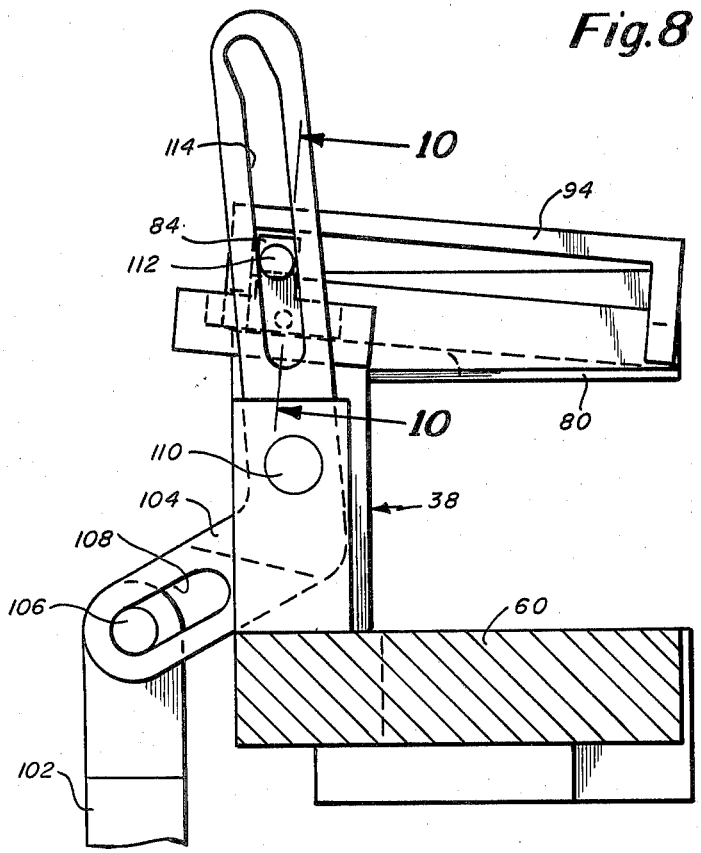
FIG. 8 is an enlarged side elevation, partly in section of the wedge mechanism as seen along the line 8—8 of FIG. 7.
Figure 9:
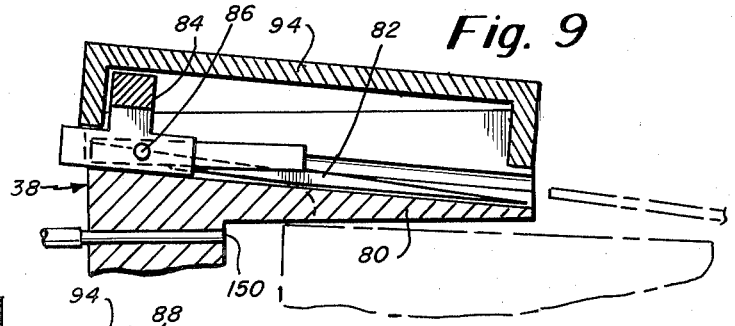
FIG. 9 is an illustration of a portion of the wedge mechanism as seen along the line 9—9 of FIG. 7.
Figure 10:
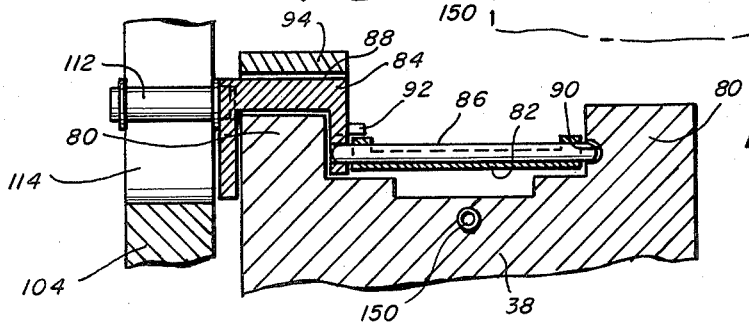
FIG. 10 is a sectional illustration of a portion of the wedge mechanism as seen along the line 10—10 of FIG. 8 and, FIG. 11 is a schematic illustration of the control circuitry of the machine.

The slide 84 is driven between its retracted, rearward position and a forward, extended position by a cylinder 98 which is connected by a linkage to the slide 84. The cylinder 98 is mounted to the carrier plate 60 by a bracket 100. The piston rod 102 of cylinder 98 is connected to a bell crank 104 by a pin 106 and slot 108 connection. The bell crank 104 is pivotally connected at a pin 110 to the heel abuttment 38. The opposite end of the bell crank 104 is connected to the slide 84 by a pin 112 which extends transversely from the slide 84 and which is received within an elongate slot 114 in the bell crank. As shown in FIGS. 8–10 the cylinder 98 is in its retracted position in which the piston rod 102 is in its downward position. When in that position, the bell crank is pivoted rearwardly to maintain the slide 84 in its rearward, retracted position as suggested in FIGS. 7–10. When cylinder 98 is actuated to extend the piston rod 102, the bell crank rotates (in a clockwise direction as seen in FIG. 8) to advance and extend the slide 84 to a forward position, thereby extending the wedge 82 to a position which will be between the heel end of the shank strip 16 and the bottom of the insole (as shown in FIG. 5).

As mentioned above, and as described in further detail in U.S. Pat. No. 4,287,628 the device includes a toe presser pad 54 and heel presser pad 56 which serves to hold the toe and heel ends of the shank strip in place during the activation and curing of the shank strip 116. In the embodiment illustrated in this description, the heel holddown 56 is normally disposed in a predetermined position so that when the shoe assembly and shank strip are raised in unison by operation of the cylinder 34, the heel end of the shank strip 16 will be brought into engagement with the heel presser pad 56 and, as the shoe assembly is urged upwardly under the influence of the cylinder 34, the heel presser pad 56 serves to press the heel end of the shank strip 16 downwardly. When the wedge 82 is interposed between the heel end of the shank strip 16 and the heel seat of the insole, the heel end of the shank strip 16 is pressed, by the presser pad 56, downwardly against the upper surface of the wedge 82. However, when the wedge 82 is in a retracted configuration, such as when it is not desired to make a spring shank, the holddown 56 will maintain the heel end of the strip 16 in firm, pressed engagement directly with the heel seat of the insole. The heel presser pad 56 is mounted for resilient upward movement and is attached to a bracket 116 which, in turn, may be connected to the lower end of a rod 118. The rod 118, in turn, is connected by a tension spring 120 to a fixed portion of the machine, such as a bar 122, as shown in FIG. 5. Thus, as the shoe assembly engages the heel presser pad 56, continued upward movement of the shoe assembly will cause the heel presser pad 56 to rise in unison with the other shoe parts and will be urged against the heel end of the shank strip 16 under the resilient force of the spring 120.

The heel presser unit preferably is mounted for adjustable heelward-toeward movement so that its longitudinal position can be adjusted to accommodate a range of shoe sizes. To this end, the heel presser pad 56 is coupled to the carrier plate 60 so that when the carrier plate is moved forwardly or rearwardly to accommodate a particular size of shoe, the heel press pad 56 will be moved in the same direction and in an amount such that will be properly positioned with respect to the heel end of the shank strip. Because of the geometry and relative length between the shank strip and the particular shoe assembly, it is desirable to move the heel presser pad 56 only a proportional amount with respect to the movement of the remainder of the heel unit. To that end, a proportional linkage arrangement 124 may be provided to move the heel presser pad 56 forwardly-rearwardly in unison with forward-rearward movement of the heel unit, but in a proportionally smaller amount. The proportional linkage 124 is shown, in the illustrative embodiment, as including a main link 126 which is pivoted, at its lower end, by a pivot 128 to a stationary part of the machine, such as frame portion 130. The upper end of the main link 126 is pivoted, at pin 132 to a link 134 which has, at its outer end, a heightwise extending integral bushing 136. The link 134 and integral bushing 136 is connected to the carrier plate 16 by a vertically extending rod 138 which passes upwardly through the bushing 36 so that the rod 138 may slide vertically with respect to and through the bushing 136.

The rod 138 is secured at its lower end to the carrier plate 60. The slideable connected between rod 138 and bushing 136 provides means by which the proportional linkage 124 will be operated in response to horizontal movement of the heel unit, but not in response to vertical movement, which is permitted freely. The extent of pivotal movement of the main link 126 thus will be a direct function of the extent of forward-rearward adjustment of the carrier plate 60. The proportional movement of the heel presser is effected by connecting the bracket 116, to which the heel presser pad 56 is connected, to an intermediate portion of the main link 126. Thus, in the illustrative embodiment, bracket 116 is connected, by an adjustable threaded member 140 to a bracket 142 which, in turn, is connected to the main link 126 at a location in between the pivots 128 and 132. Thus, the longitudinal position of the heel presser pad 56 is adjustable in unison with, but in an amount proportionally smaller to, the longitudinal position of the carrier plate 60.

The general mode of operation of the machine is substantially similar to that described in U.S. Pat. No. 4,161,048 except that accommodation is made for operation of the cylinder 98 to operate the wedge systemm. In the present invention, a manually operable selection control is provided on the machine so that the operator may select whether the machine is to be operated to make shoes with a spring shank or to make shoes in the conventional manner in which the entire shank strip, including the heel end, is applied to the full bottom of the shoe insole. When the machine is operated in the conventional mode, cylinder 98 is actuated so that its piston rod is in a retracted, lowered position which, as described above, maintains the wedge in its retracted, out-of-the-way position. The cylinder 98 and wedge remain in that position at all times throughout the complete cycle of operation of the machine.

However, when the machine is operated to make shoes which incorporate a spring shank, the manual selector switch is set so that the cylinder 98 is actuated to extend the piston rod 102, thereby operating the bell crank 104 to extend the wedge to its foward position. As described more fully below in connection with the operational sequence of the machine, the wedge will remain in its extended position throughout the full operating cycle of the machine except for a brief interval when the shoe is to be taken out of the machine. During that interval, the cylinder 98 is cycled briefly to retract the wedge 82 from between the heel end of the shank strip and heel seat of the insole to prevent the shank strip from being dislodged by the wedge as the shoe assembly drops downwardly out of the machine.

The sequential operation of the various elements of the machine is described in detail in prior U.S. Pat. No. 4,161,048 and will not be repeated here. The following description of the control circuitry shown in FIG. 11 is limited to modifications to the control circuitry of the machine to illustrate the manner and sequence in which the wedge cylinder 98 is operated. As shown in FIG. 11, the wedge cylinder 98 controlled by valve V1 which directs air under pressure, from a source S, effectively to the head and rod end of the wedge cylinder 98. Valve V1 is a spring biased valve normally biased to direct air to the head end of wedge cyclinder 98, thereby normally maintaining the wedge in its extended configuration, so as to make spring shanks. The machine includes a manual selector valve V2 which is operated selectively to shift valve V1 between its normally biased configuration and overridden configuration in which the piston rod of the cylinder 98 is retracted (thereby retracting wedge). The manual control valve V2 includes two manually selected positions, one of which communicates air under pressure, through line L1 to shuttle value SV1. When shuttle valve SV1 shifts, that pilots valve V1 to shift it to its overridden configuration in which air under pressure is directed to the head end of the cylinder 98 through L2, while the rod and the cylinder 98 is exhausted through line L3. Thus, when making spring shanks, manual selector valve V2 is shifted to permit the spring biasing of control valve V1 to maintain cylinder 98, (and therefore, the wedge) in an extended configuration. Ultimately, if it is desired to make shoes which do not have the spring shank, but in which the shank lies fully along the length of the shoe bottom, manual selector valve V2 is shifted to direct air under pressure through line 1 to shuttle valve SV1 thereby maintaining valve V1 in its shifted configuration in which the pressure is applied to the rod end of the cylinder 98, thereby maintaining the cylinder in its downward retracted configuration. When in that configuration, the cylinder 98 will remain retracted throughout the complete cycle of operation of the machine.

Figure 4:
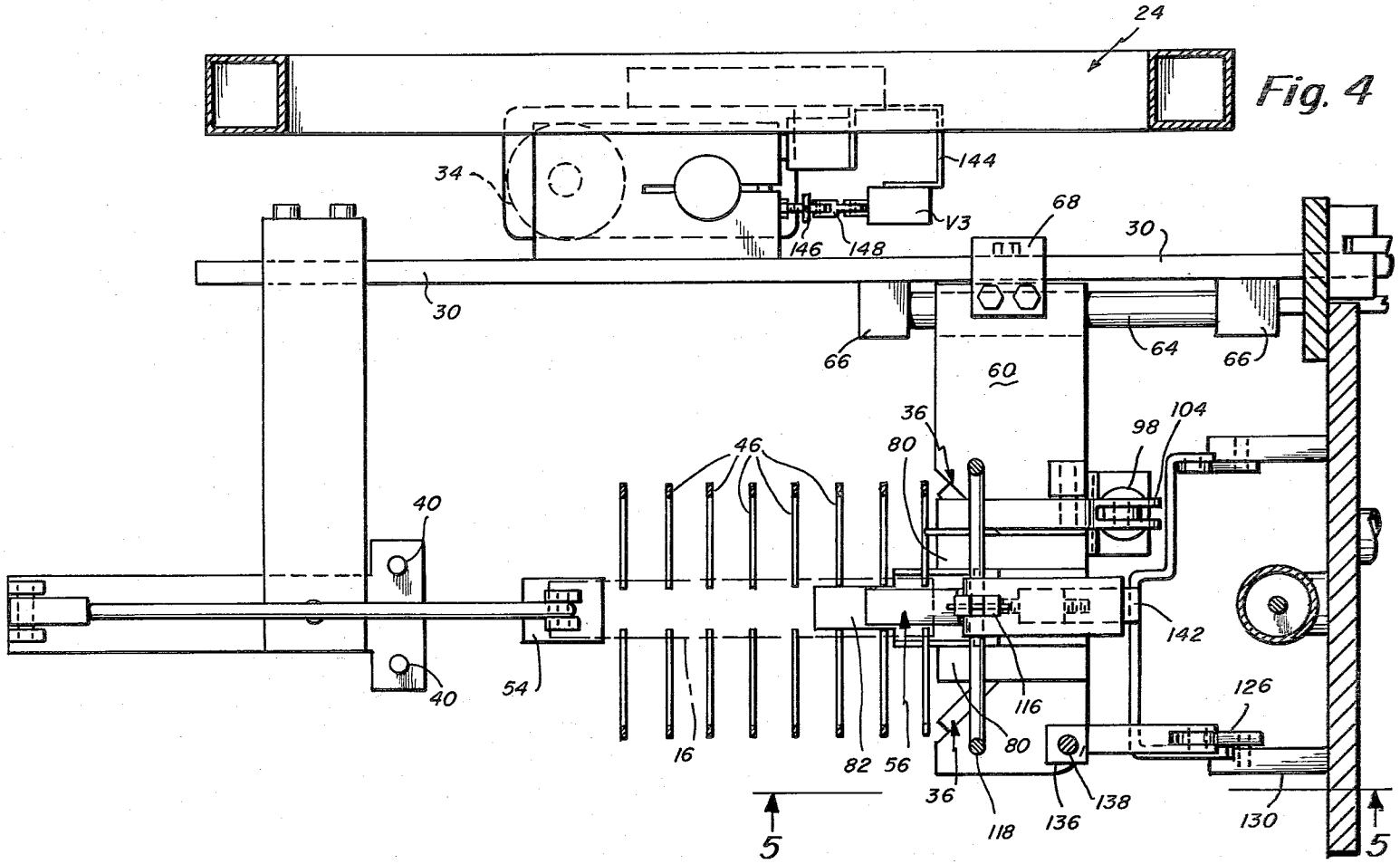
FIG. 4 is a partly sectional plan view of the machine as seen along the line 4—4 of FIG. 1.

When operating in the spring shank mode, in which the valve V1 is permitted to operate under the influence of its spring bias, means are provided to shift valve V1 briefly, after the shank strip has been applied, and just as the shoe assembly is permitted to drop from the machine. As described above, withdrawal of the shank is necessary so that the wedge does not knock the shank off the bottom of the shoe as the shoe assembly drops dowwardly out of the machine. To this end, means are provided for briefly directing a pulse of air under pressure to valve V1 to shift and cycle the valve V1 briefly so as to cycle the work cylinder 98. To this end, a control valve V3 is mounted to the frame of the machine, by a bracket 144 (see also FIG. 4). The valve V3 is interposed in the control circuitry as shown in FIG. 11, so that its output is connected, through line L4, to shuttle valve V1. Normally, valve V3 is spring biased so that there is no air pressure in line L4. Valve V3, however, is actual in response to downward movement of the shoe supporting assembly, as driven by cylinder 34. To that end, a cam 46 is mounted to a portion of the moveable shoe support assembly for movement in unison with the shoe assembly. Cam 146 is located with respect to the actuator 148 which controls operation of the valve V3. The actuator 148 is a one-way type and is constructed so as to permit cam 146 to move upwardly past the actuator 148 without tripping it, but so as to trip the actuator 148 only during downward movement (when the shoe assembly advances downwardly). Thus, after the shank strip attaching operation has been completed, downward movment of the shoe assembly, under the influence of main cylinder 34, causes cam 146 to trip actuator 148 of valve V3, thereby shifting valve V3 and permitting air under pressure to flow from the source S, through valve V3 and line L4 to shuttle valve SV1 which shifts valve V1. The shifting of valve V1, as described above, applies pressure to the rod end of cylinder 98 (through line L3) and exhausts line L2 thereby retracting the cylinder 98 and withdrawing the wedge heelwardly from beneath its position between the heel end of the shank strip and the shoe bottom. Wedge cylinder 98 will remain in its retracted configuration until cam 146 clears and releases the actuator 148 thereby enabling valve V3 to shift back to its normally biased configuration. When that occurs, pressure on shuttle valve SV1 is released thereby enabling valve V1 to shift back to its biased configuration to return the wedge cylinder 98 to its raised position in which the wedge is returned to its extended configuration, in readiness for a new cycle of operation.

The control cycle also includes a second and manually operable valve V4 which may be selectively operated to permit or preclude air to be blown onto the wedgy through orifice 150. As described, maintaining cooling air on the wedge surfaces prevents resin from curing and adhering to the wedge surfaces, thereby maintaining the wedge in a smooth surfaced configuration.

It should be understood that the foregoing description of the invention is intended merely to be illustrative thereof and other modifications and embodiments may be apparent to those skilled in the art without departing from its spirit.

Having thus described the invention, what I desire to claim and secure by Letters Patent is:

1. An apparatus for applying a strip of activatable, curable material to the bottom of an insole to form a stiffener in situ on the bottom of the insole comprising:

means for maintaining the strip of material in a predetermined location on the bottom of the insole;

means for supporting at least a portion of the strip in spaced relation to the insole whereby said portion will remain detached from the insole and may be cured in said detached configuration.

2. An apparatus as defined in claim 1 wherein the means for supporting the portion of the strip comprises:

an independent strip supporting element movably mounted between an operative position in which it is supportive of a predetermined portion of the strip and an inoperative remote position.

3. An apparatus as defined in claim 2 further comprising means for moving the strip supporting element between said operative and remote positions.

4. An apparatus as defined in claim 2 wherein the stiffener comprises a shank element and within the operative position of the strip supporting element is between the heel end of the shank strip and the insole.

5. An apparatus as defind in claim 1 wherein the support means is wedge-shaped.

6. An apparatus as defined in claim 3 further comprising control means for selectively locating the support member in its remote or operative position.

7. An apparatus as defined in claim 3 further comprising means for retracting the support means from its operative position for time intervals at least sufficient to enable removal of the shoe assembly from the apparatus without disrupting the stiffener.

8. An apparatus as defined in claim 1 wherein the activatable material is resinous, the apparatus further comprising means for directing a stream of cooling gas on the supporting means thereby to retard curing of resinous material in direct contact with the support means, thereby to maintain the support means substantially clean.

9. A method for forming and applying a shank stiffener on the bottom of a shoe sole, said stiffener initially being in the form of an elongate flexible activatable material, the method comprising:

placing the stiffener material on the bottom of the insole;

supporting a portion of the stiffened material in spaced relation to the insole;

effecting curing of the stiffener material while said portion of the stiffener material is so supported whereby a part of the stiffener will cure in contact and conformity with the bottom of the insole and where a portion of the stiffener will cure in a spaced relation to the insole.

10. A method as defined in claim 9 wherein said step of supporting the stiffener material comprises interposing a wedge-shaped supporting member between the stiffener material and insole.

11. A method as defined in claim 9 wherein the suported portion of the stiffener material is at the heelward end of the stiffener material.

* * * * *